United States Patent [19]

Imhauser et al.

[11] 4,201,482

[45] May 6, 1980

[54] PERFORATED MIXING ELEMENTS FOR STATIC AND DYNAMIC MIXERS

[75] Inventors: Günter Imhäuser, Cologne; Dieter Brauner, Solingen; Edgar Muschelknautz, Leverkusen, all of Fed. Rep. of Germany

[73] Assignee: Bayer Aktiengesellschaft, Leverkusen, Fed. Rep. of Germany

[21] Appl. No.: 960,816

[22] Filed: Nov. 15, 1978

[30] Foreign Application Priority Data

May 20, 1978 [DE] Fed. Rep. of Germany ..... 2822096

[51] Int. Cl.[2] ..... B01F 5/00; B01F 7/00

[52] U.S. Cl. ..... 366/98; 366/279; 366/340

[58] Field of Search ..... 366/336, 340, 279, 98, 366/99, 90, 324; 138/37, 38, 40, 42; 48/180 R, 180 B, 180 M, 180 C; 261/DIG. 16, DIG. 72, 76

[56] References Cited

U.S. PATENT DOCUMENTS

| | | | |
|---|---|---|---|
| 1,887,704 | 11/1932 | Wilisch | 261/DIG. 72 |
| 2,584,827 | 2/1952 | Bailey | 366/340 X |
| 3,682,443 | 8/1972 | Upmeier | 366/336 |
| 3,871,624 | 3/1975 | Huber et al. | 366/336 |
| 4,027,857 | 6/1977 | Cunningham | 366/340 |

*Primary Examiner*—Philip R. Coe

[57] ABSTRACT

A mixing insert of solid material into which intersecting channels are drilled is particularly suitable for use as a static mixer for highly viscous liquids. The insert provides a high quality of mixing while withstanding pressure differences of more than $10^7$ Pa along the mixer. If the insert is rotated, static and dynamic mixing properties are superimposed on each other in the mixer. Either forward transport of the materials or return for remixing can be particularly promoted according to the sense of rotation and form of the external channels, which must be partly open.

16 Claims, 16 Drawing Figures

PERFORATED MIXING ELEMENTS FOR STATIC AND DYNAMIC MIXERS

This invention relates to inserts for mixers containing at least one pair of intersecting channels, and to their use in static and dynamic mixers.

In German Auslegeschrift No. 23 28 795 and German Offenlegungsschrift No. 25 22 106 there have been described mixing elements comprising intersecting plates into which cross-pieces are cut and other, similarly operating elements comprising intersecting bars arranged on a connecting web which extends transversely through the housing and with which they form a single piece. The plates and bars of such elements are relatively thin walled and generally only joined together at isolated points by soldering or welding. The individual elements have a ratio of length to diameter of from 1 to 3 and the pressure loss in the event of a laminar flow through them is about 20 to 50 times greater than in any empty tube of the same diameter. When, for example, such elements are installed in the housing of extruders, at the end immediately after the shaft, the mixing inserts are liable to be destroyed at the usual rates of throughput and viscosities of polymer melts because the pressure losses exceed their mechanical strength.

It is an object of this invention to provide inserts for mixers which are sufficiently stable to withstand pressure losses of at least $10^7$ Pa along the mixer but preserve the advantages of known mixers, in particular the high quality of mixing combined with the short length of the apparatus.

According to the present invention, there is provided an insert for a mixer, the insert comprising at least one pair of intersecting channels, wherein the insert comprises a solid material in which the channels lie in parallel planes, each channel inclined at an angle $\alpha$ of from 20° to 70° to the longitudinal axis of the insert projected in the parallel planes, the angle $\alpha$ being alternately positive and negative in successive planes so that the channels of adjacent planes intersect to form a grid and the channels being such that channels on adjacent planes overlap by up to 40% of their cross-section at their point of intersection.

The invention further provides a static mixer, a dynamic mixer and an extruder shaft comprising an insert according to the invention.

Instead of achieving the high strength of the inserts in the apparatus according to the invention in the same way as in known inserts, by increasing the thickness of the material and welding the elements together at their points of intersection, which is problematic and expensive, it is achieved by producing the mixing insert from a solid, preferably cylindrical, metal block. In practice, it would be suitable to use inserts with a diameter of from 10 to $10^3$ mm. The inserts can also withstand unilateral pressures of $10^7$ Pa. The preferred range for the length of an insert according to the invention is from 1 to 4 times that of its diameter. The mixing inserts may be used both in static and in dynamic mixers. The mixing action of the new insert is at least as efficient as that of known insert which have intersecting plates or cross-pieces. The pressure loss is approximately 4 times greater in cylindrical bores and approximately 2 times greater in slots.

If a cylindrical mixing insert according to the invention is rotated in a suitable housing, the resulting unit is a dynamic mixer in which the action is always partly also that of a static mixer. It has also been found that if the extruder is rotated at a sufficiently high speed, an even better mixing action can be obtained if an insert according to the invention which has a length of from 2 to 4 times its diameter is attached to the front of the extruder shaft as an extension and allowed to rotate with it. In this case, where the mixer is half static and half dynamic in action, the bores or slits should be arranged so that the outermost lateral channels appear as open grooves and act as parts of screw threads when the apparatus is in rotation.

In cases where a certain amount of mixing in the longitudinal direction is required in addition to transverse mixing, the total mixing effect can be considerably improved if the outer grooves which act as screw elements also carry the material backwards. The pressure loss is in that case, of course, greater than in fixed inserts. If only transverse mixing is required, the inserts should be arranged to assist in the forward movement of the material. If they carry the material forwards in the main direction of the stream, the pressure loss is considerably less than in static inserts but the mixing effect is more efficient. If the circumferential velocity of the rotating mixing element is a multiple, at least double the average throughflow velocity, based on an empty tube, the mixing effect is approximately equal to that of four static mixing inserts arranged one behind the other.

The apparatus according to the invention is illustrated in the drawings and described below by way of example.

Figure 1:
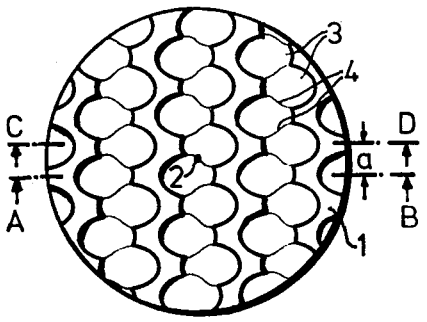
FIG. 1 is a top plan view of a cylindrical mixing insert with cylindrical channels.

FIG. 1 is a top plan view of a solid perforated metal cylinder 1. Cylindrical channels 3 extend obliquely to the cylinder axis 2. The channels 3 all lie in planes which, in this example, are parallel to lines A-B and C-D. The channels 3 extend in planes parallel to each other but not to the cylinder axis 2. It can be seen that the cross sections of two intersecting channels partly overlap.

Figure 3:
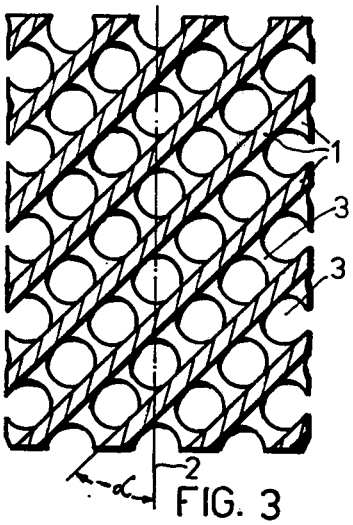
FIG. 3 is a longitudinal section through a cylindrical mixing insert (section line C-D in FIG. 1).
Figure 2:
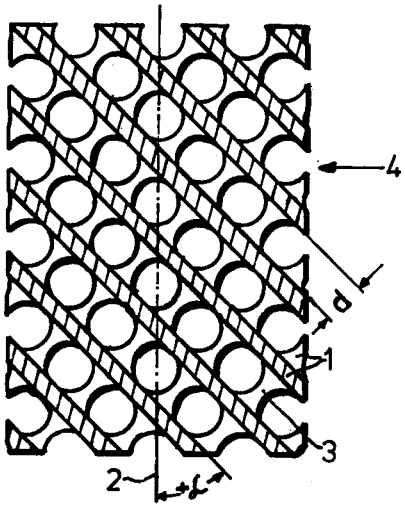
FIG. 2 is a longitudinal section through a cylindrical mixing insert (section line A-B in FIG. 1).

In the sections A-B and C-D in FIGS. 2 and 3, the same reference numerals have been used as in FIG. 1. The cylinder axis 2 is in both cases projected onto the plane of the section. The channels 3 in the plane A-B are inclined at an angle $+\alpha$ to the axis of the cylinder. In the sectional view of FIG. 3, the inclination of the channels to the cylinder axis is also 60 but with a sign reversal so that it has been marked as $-\alpha$. The distance between two adjacent planes is indicated by reference a. The semi-minor axis of the ellipse in FIG. 1 is equal to the radius of a channel 3.

Figure 4:
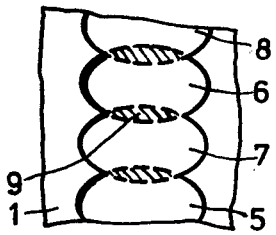
FIG. 4 is a schematic representation of the overlapping channels at the points of intersection (in an insert of FIG. 1).

The overlapping of the cylindrical channels 3 at the points of intersection is again shown schematically in FIG. 4. It should be imagined that channels 5 and 6, for example, extend from the left at the front to the right at the back into the paper while channels 7 and 8 extend from the right at the front to the left at the back into the paper and that all these channels partly overlap in the plane of the drawing and in other parallel planes above and below this plane. The overlap should preferably be from 10 to 30% of the channel cross-section.

Figure 5:
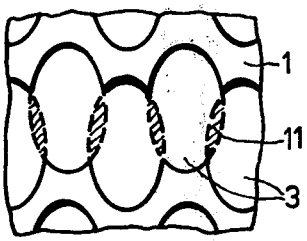
FIG. 5 is a schematic representation of the overlapping channels at the periphery of the mixer (viewed in direction 4 in FIG. 2).
Figure 6:
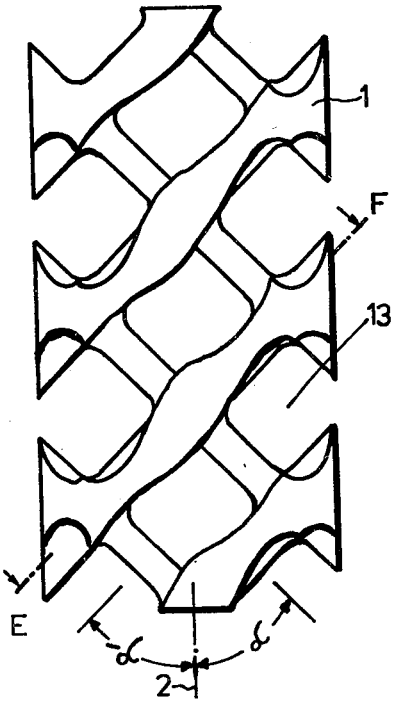
FIG. 6 is a side view of a mixing insert in which the cross section of the channel has the form of an elongated aperture.

FIG. 5 represents schematically a section taken out of the side wall of the mixing element, viewed in direction 4 of FIG. 2. In this case, the ends of the channels 3 also have small areas of intersection 11 with the beginnings of the two adjacent or at least one adjacent channel 3. The outermost bores may lie so far on the outside that they form an open channel (for example at 12 in FIG. 9).

Figure 8:
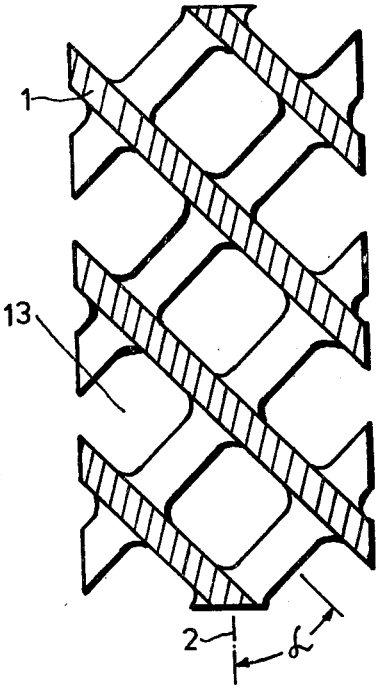
FIG. 8 is a longitudinal section through the mixing insert of FIG. 6 (section line G-H of FIG. 7).
Figure 9:
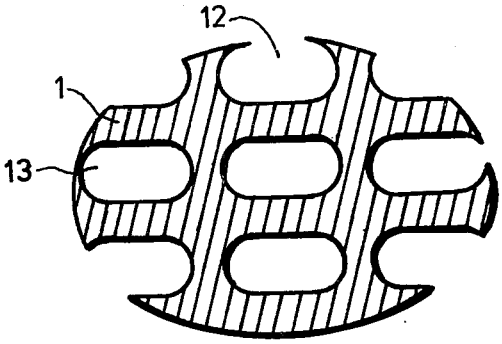
FIG. 9 is a section through the mixing insert of FIG. 6 (section line E-F of FIG. 6).
Figure 10:
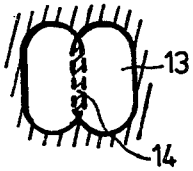
FIG. 10 is a schematic representation of the overlapping channels at a point of intersection in an insert of FIG. 6.

Another advantageous form of mixing element is represented in FIGS. 6 to 10. Apart from the size of the channels, this mixing element differs mainly by the cross sectional form of the channels. In FIGS. 1 to 5, the channels are circular in cross section whereas in FIGS. 6 to 10 they are elongated, i.e. the cross section consists of two semi-circular surfaces connected by the sides of a rectangle. The angle of inclination of channels 13 to the cylinder axis is again marked as $+\alpha$ and $-\alpha$. The distance between two adjacent planes is adjusted to the cross section of the channels so that overlaps 14 occur at the points of intersection as shown in FIG. 10. The overlap is preferably in the region of 10 to 30% of the channel cross-section.

Figure 7:
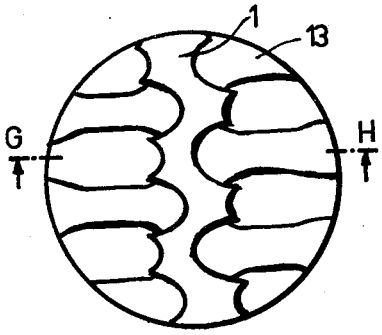
FIG. 7 is a top plan view of the mixing element of FIG. 6.

The longitudinal sectional area represented in FIG. 8 is indicated by a line G-H in the top plan view of FIG. 7. The sectional surface in FIG. 9 is indicated by a line E-F in the side view of FIG. 6. The elongated form of the channels 13 is shown in FIG. 9. A section taken as in FIG. 9 shows only every second plane containing channels. In this example, the channels are arranged in the mixing element so that if the mixing element is thought of as assembled from individual planes, the odd numbered and even numbered planes are superimposed on each other in such a manner that the channels also lie above one another. In similar sections represented in FIGS. 14 and 16, on the other hand, the channels are staggered so that each one is preferably in alignment with a gap between two channels in an adjacent plane. In this way, the mixing action can be further improved over the cross section.

Figure 11:
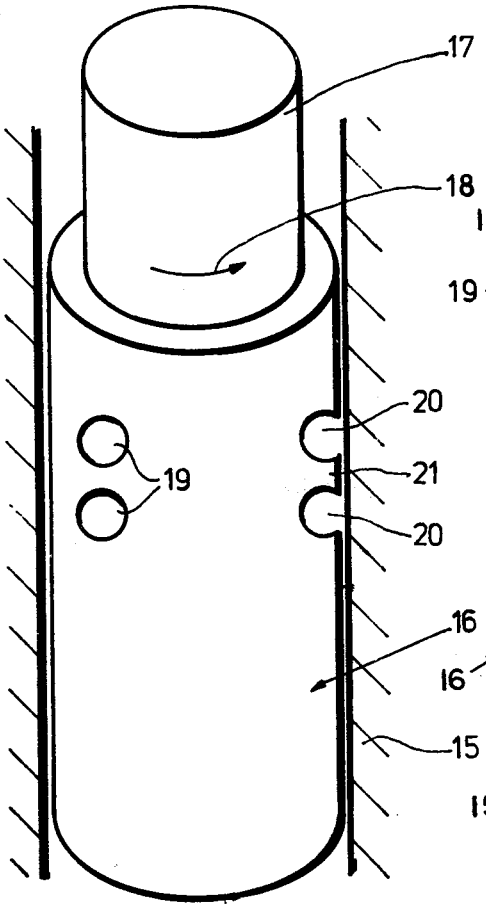
FIG. 11 is a schematic perspective view of a rotating mixing insert.
Figure 12:
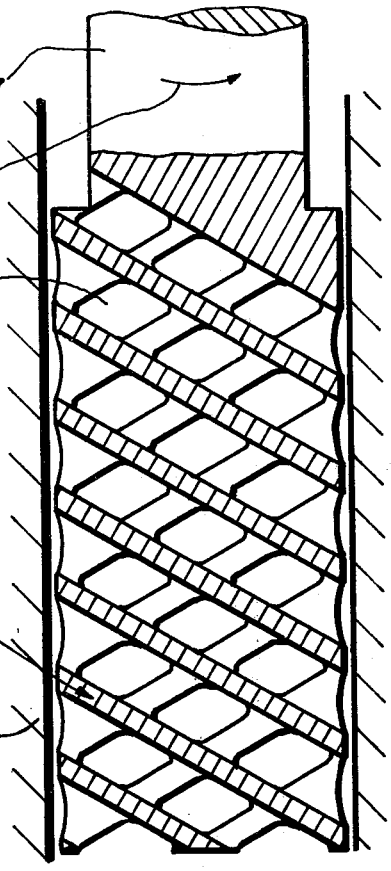
FIG. 12 is a longitudinal section through a rotating mixing insert of FIG. 11.
Figure 13:
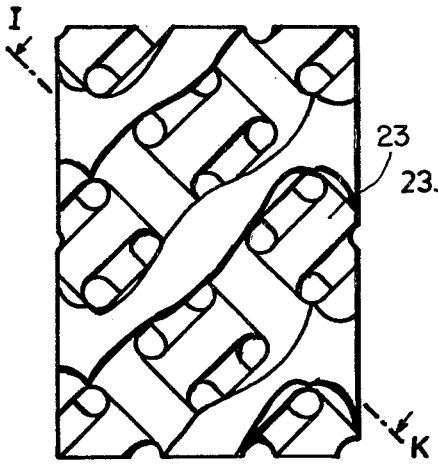
FIG. 13 is a side view of a mixing insert with staggered slots.

FIGS. 11 and 12 represent mixing elements rotating in a housing 15. The insert comprises a cylindrical mixing element 16 according to the invention and a driving stump 17. For certain purposes, the sense of rotation 18 indicated in the Figure may be reversed. The clearance of the mixing element 16 in the housing 15 is only slight.

The channels are formed so that open channels 20 are obtained on one side, as indicated schematically in FIG. 11, but these channels have a closed circumference over most of their length on the other side. For the sake of clarity, only two side openings from two planes are shown in FIG. 11. The other bores in the same plane and the intersecting bores from the other planes have been omitted. Between the open channels 20 at the sides are cross-pieces 21 which act like screw threads of an extruder due to the rotation of the mixing insert. Cross-pieces with the action of screw threads of the same pitch are also formed on the other side due to the open bores (not shown) of the intersecting channels. The sense of rotation 18 can be selected so that the cross-pieces function as a screw carrying the material either forwards or backwards in the direction of flow of the product. Such cross-pieces which either promote or inhibit transport of material in the same sense on each side are advantageous if the body of rotation is short. In the case of longer bodies of rotation, it may be advantageous if on each side, the outermost channels of the same group of parallel bores are open channels. In that case, the mixer transports material forwards on one side and backwards on the other, thus forming cells with the required re-mixing action. The length of a rotating mixing insert is advantageously greater than twice the diameter of the element. The outer channels are preferably arranged so that they form sloping cross-pieces on the circumference, as in a screw, and the residual cross section of the open channel at its deepest point should be at least 50%, preferably from 50 to 66% of the cross section of the other channels in the interior of the body.

Figure 14:
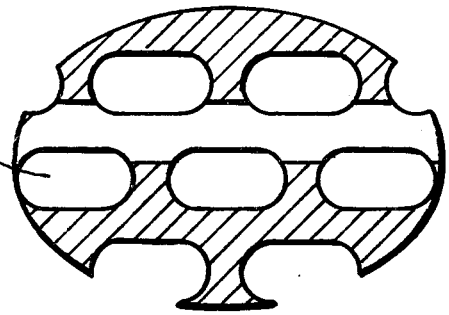
FIG. 14 is a section through a mixing insert according to FIG. 13 (section line I-K of FIG. 13).
Figure 15:
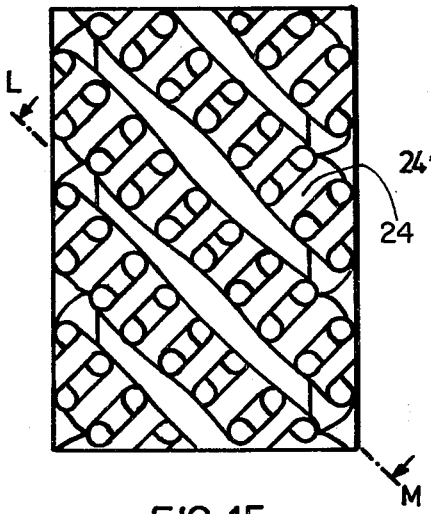
FIG. 15 represents mixing inserts with intersecting cylindrical bores which are staggered in height.
Figure 16:
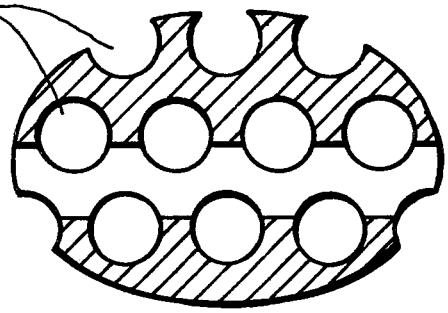
FIG. 16 is a section through a mixing insert according to FIG. 15 (section line L-M of FIG. 15).

FIGS. 13 to 16 again show cylindrical mixing inserts which differ from the mixing inserts in FIGS. 1 to 12 by the fact that cylindrical channels or slots 23, 24 are staggered. In sections taken, as in FIGS. 9, 14 and 16, perpendicular to a group of channels in the mixing insert, the positions of the channels 12, 13, 23 and 24 may be related to each other so that they appear as a rectangular grid (FIG. 9) in this section or as a grid set at an oblique angle (FIGS. 14, 16). The staggered arrangement whereby each channel is in alignment with a gap between two channels in an adjacent plane is particularly preferred. The over lapping of adjacent channels at the points of intersection is also obtained as an essential feature of this invention in such an "oblique angled" grid.

In a special application polyamide melt was fed to a spinning nozzle with 150 perforations via a tube of 20 mm diameter at a speed of 1.34 cm/s. The pressure prior to the nozzle and the filter was $5 \cdot 10^6$ Pa, the viscosity of the melt being 300 Pa s. Owing to variations in the residence time in the feed-pipe of the order of 1:10 the melt was not completely homogeneous. The slow circular layers had a higher molecular weight than the more rapid layers of the core stream. After incorporating a static mixer as described in U.S. Patent Application Ser. No. 679,113 with three inserts, each being 20 mm in diameter and 38 mm in length, a very good mixing and a corresponding improvement of the spinning procedure was achieved. The pressure loss of these inserts was $5 \cdot 10^6$ Pa.

When a disturbance occurred, the viscosity of the melt, and thus also the pressure loss, more than doubled.

The mixing inserts punched out of 1 mm thick, stainless steel and welded to the cross-pieces were pressed together in some places. In their place four inserts were fitted into a device according to the invention, each having a diameter of 20 mm and a length of 30 mm. Between the inserts, each turned at an angle of 90° to the other, there were 5 mm thick perforated sheets, each having 12 perforations, each 3.5 mm in diameter. The bores were bevelled at 90°, each over a length of 2 mm at the inlet and outlet.

The mixing inserts had bores with a diameter of 4 mm. These were arranged in intersecting groups parallel to each other at 45° to the axis. The interval between the parallel bores of each group was 6 mm. The interval between the axis of intersecting bores was 3 mm at the intersection point, the overlapping was 25%.

The pressure loss of the bored inserts including the three perforated sheets was $9 \cdot 10^6$ Pa. The spinning process was improved by the mixture according to the invention (fewer tears in the filaments). In laboratory tests these inserts made from a stainless steel were operated surely and without any damage with pressure losses up to $2.5 \cdot 10^7$ Pa.

In a further application 800 g/h of an antistatic additive were mixed into a polyamide melt stream of 30 kg/h, the melt having a viscosity of 300 Pa s, the additive a viscosity of 5 Pa s and not dissolving in the melt. With a rotating mixer according to the invention this additive was so well mixed that at the end of the mixer droplets smaller than 7.5 μm were equally distributed over the whole cross-section. The rotating mixer consisted of an insert of 60 mm in diameter and 240 mm in length. The bores were 9 mm in diameter. The channels intersecting each other in each case were each inclined at an angle of 45° to the axis. The bores of each group were not staggered but in each case arranged at the same length of the mixing insert. The intervals between the bores running parallel to each other were 13 mm, the intervals between the intersecting bores were 65 mm at the point of intersection, the overlapping at the sites of intersection was 30%.

By means of this arrangement of the bores, in each case 13 open slots were produced carrying the material along in a similar manner to that of a screw, and these slots were 7 mm deep at their deepest point.

The pressure loss of this mixer at a rotating speed of 40 r.p.m. was $3 \cdot 10^5$ Pa. The mixer achieved the same mixing effect as 8 static inserts of the same type, whose pressure loss would be $5 \cdot 10^6$ Pa. The performance of the rotating mixer was 0.3 kW.

In a further application according to the invention, in the production of PVC-film a granular mass was melted in an extruder of 1,600 mm in length with a screw of 60 mm in diameter, thread depths of 10 to 3 mm and the width of the cross-pieces of the threads being 6 mm. With a throughput of 30 kg/h and a viscosity of 900 Pa s of the melt, the extruder could build up a pressure above $10^7$ Pa. The melt exhibited at the end of the extruder temperature differences of ±15° C. at an average temperature of 280° C.

By means of a mixing insert, attached to the end of the extruder screw and rotating in the same direction as this and having the same measurements as in the previous example, the temperature uniformity measured at the end of the mixing insert with variations of ±2° C., was quite considerably improved. The open slots at the sides of the mixing insert aided conveyance. The difference in pressure necessary for the mixing insert was less than $5 \cdot 10^5$ Pa, the additionally required performance was 1.2 kW.

What we claim is:

1. An insert for a mixer, the insert comprising at least one pair of intersecting channels, wherein the insert comprises a solid material in which the channels lie in parallel planes, each channel inclined at an angle $\alpha$ of from 20° to 70° to the longitudinal axis of the insert projected in the parallel planes, the angle $\alpha$ being alternately positive and negative in successive planes so that the channels of adjacent planes intersect to form a grid and the channels being such that channels on adjacent planes overlap by up to 40% of their cross-section at their point of intersection.

2. An insert as claimed in claim 1, wherein the angle of inclination $\alpha$ of the channels to the longitudinal axis of the insert is from 30° to 60°.

3. An insert as claimed in claim 1 or 2, wherein the channels on adjacent planes overlap by from 10 to 30% of their cross-sections at their point of intersection.

4. An insert as claimed in any claim 1, wherein the insert is cylindrical.

5. An insert as claimed in claim 1, wherein the channels are cylindrical bores and the channels on adjacent planes overlap by at least 10% of their cross-section at their point of intersection.

6. An insert as claimed in claim 1, wherein the channels have the cross-sectional form of one of elongated apertures or slots.

7. An insert as claimed in claim 1, wherein in a section taken through the insert perpendicular to the longitudinal axes of a group of the channels, the channels on adjacent planes are in line with each other.

8. An insert as claimed in claim 1, wherein in a section taken through the insert perpendicular to the longitudinal axes of a group of the channels the channels on adjacent planes are staggered with respect to each other.

9. An insert as claimed in claim 8, wherein the channels are staggered so that each channel is in alignment with a gap between two channels in the adjacent plane or planes.

10. A static mixer comprising an insert as claimed in claim 1.

11. A static mixer comprising a plurality of inserts as claimed in claim 1 arranged one behind another and rotated through an angle with respect to each other.

12. A static mixer as claimed in claim 11, wherein the inserts are rotated with respect to each other through an angle such that the planes containing the channels of two successive inserts are perpendicular to each other.

13. A static mixer as claimed in claim 11 or 12, wherein gaps of up to 5 times the diameter of the inserts exist between the inserts.

14. A static mixer as claimed in claim 13, wherein at least one perforated plates or pieces of wire mesh are placed in each of the gaps.

15. A dynamic mixer comprising an insert as claimed in claim 1, wherein the insert is such that channels open to the longitudinal surface of the insert having a residual cross-section of at least 50% of that of the channels in the interior of the insert.

16. An extruder shaft which comprises an insert as claimed in claim 1 as a front extension.

* * * * *